United States Patent [19]

Young

[11] Patent Number: 4,496,876

[45] Date of Patent: Jan. 29, 1985

[54] FREQUENCY-SPREADING COUPLER

[75] Inventor: Leo Young, Bethesda, Md.

[73] Assignee: The United States of America as represented by the Secretary of the Navy, Washington, D.C.

[21] Appl. No.: 422,122

[22] Filed: Sep. 23, 1982

[51] Int. Cl.[3] ..... H01J 25/00

[52] U.S. Cl. ..... 315/4; 315/5; 315/3.6; 315/39.3; 328/233; 333/208; 333/210; 330/43

[58] Field of Search ..... 315/3, 4, 5, 3.6, 39.3; 328/233; 333/208, 210, 308, 310; 330/43

[56] References Cited

U.S. PATENT DOCUMENTS

| | | | |
|---|---|---|---|
| 3,046,503 | 7/1962 | Cohn | 333/210 |
| 3,273,011 | 9/1966 | Brown | 315/34 |
| 3,398,376 | 8/1968 | Hirshfield | 315/5 |
| 3,571,651 | 3/1971 | Wilbur | 315/3.6 |
| 3,611,214 | 10/1971 | Gerlack | 333/208 |
| 3,887,832 | 6/1975 | Drummond et al. | 315/4 |
| 4,053,810 | 10/1977 | James | 315/3.6 |
| 4,070,595 | 1/1978 | Miller | 328/233 |
| 4,143,299 | 3/1979 | Sprangle et al. | 315/5 |
| 4,224,567 | 9/1980 | Granatstein et al. | 315/5 |

*Primary Examiner*—Saxfield Chatmon

*Attorney, Agent, or Firm*—Robert F. Beers; William T. Ellis; Charles E. Krueger

[57] ABSTRACT

A wide band travelling wave amplifier including an input waveguide coaxially disposed about an interaction waveguide. Both waveguides are tapered with the same direction of increasing cross-section. The interaction waveguide is a high-pass filter while the input waveguide is a low pass filter. The input waveguide is positioned relative to the interaction waveguide so that each cutoff plane in the input waveguide corresponding to a given frequency, $\omega_c$, is displaced in the direction of increasing cross-section from a cutoff plane in the interaction waveguide corresponding to $\omega_c$ where $\omega_c$ is any frequency in the frequency band of the amplifier. A slot, disposed between the cutoff planes corresponding to $\omega_c$ couples the $\omega_c$ frequency component of an input wave from the input waveguide to the interaction waveguide.

22 Claims, 6 Drawing Figures

FREQUENCY-SPREADING COUPLER

BACKGROUND OF THE INVENTION

The present invention relates generally to millimeter and submillimeter wave amplifiers, and more particularly, to a traveling wave amplifier with a special wide-band frequency-spreading coupler for wide-band operation at high power levels.

Information carrying systems such as radar and other communications devices require an amplifier mechanism with substantial instantaneous bandwidth rather than simply an oscillation mechanism. In order to provide wide-band high power operation in traveling wave amplifiers, the use of a tapered interaction waveguide in conjunction with a specially profiled magnetic field has been proposed in Application Ser. No. 06/389,133, entitled "Wide-Band Gyrotron Traveling - Wave Amplifier" by Y. Y. Lau, L. R. Barnett, K. R. Chu, and V. H. Granatstein. The gyrotron traveling-wave amplifier disclosed therein comprises a tapered waveguide wherein the cross-section thereof gradually increases from a small first end to a large second end for propagating electromagnetic energy therein, a magnetron device for generating a beam of relativistic electrons with helical electron motion for application to the small first end of the tapered waveguide to propagate in the axial direction therein, a magnetic circuit for generating a tapered magnetic field within the waveguide in a direction approximately parallel to the axis of the waveguide, and an input coupler for launching an input electromagnetic wave so that it co-propagates with the electron beam in the waveguide.

The above-mentioned waveguide is tapered such that its cutoff frequency varies over a predetermined bandwidth. This device then utilizes a reverse rf injection scheme wherein the electromagnetic wave to be amplified is applied at the large end of the tapered waveguide so that it propagates in the waveguide until its individual frequencies are reflected when they reach the point in the waveguide taper where they approximately match the cutoff frequency of the waveguide. These reflected frequencies then copropagate with and are amplified by the electron beam. The above described injection scheme utilizes a single port for the injection and extraction of radiation energy from the amplifier thereby requiring either a circulator or 3 dB hybrid junction device to separate the input and output radiation at the amplifier port. These separation devices limit the amplifier gain due to the impossibility of perfectly matching the components.

A distributed mode coupler has been disclosed in Application No. 389,132, entitled "Wide-Band Distributed rf Coupler" by L. R. Barnett. In that application an input waveguide is coupled by a plurality of channel frequency filters to the tapered interaction waveguide of the amplifier. The filters are positioned so that the interaction waveguide cutoff frequency approximately matches the wave frequency propagated by the filter thereby maximizing the gain in the amplifier. The coupler disclosed in Application No. 389,132 is a complex structure requiring the fabrication of precision channel filters. The bandwidth of the coupler is limited by the number of channels. Additionally, the distributed coupler does not have a continuous bandwidth profile since only those frequencies matched to a channel filter are coupled to the amplifier.

OBJECTS OF THE INVENTION

Thus, it is an object of the present invention to develop an improved broad-band input coupler for a distributed traveling wave amplifier with a tapered interaction waveguide.

It is a further object of the present invention to develop a broad band input coupler with a geometry which is compatible with the geometry of a distributed gyrotron amplifier.

It is yet a further object of the present invention to develop a broad-band input coupler for a distributed gyrotron amplifier which is highly efficient.

It is yet a further object of the present invention to develop a broad-band input coupler which can be used generally with electron beam traveling-wave amplifiers.

It is yet a further object of the present invention to develop a broadband input coupler for a gyrotron that does not require a plurality of matched components.

Other objects, advantages, and novel features of the present invention will become apparent from the detailed description of the invention, which follows the summary.

SUMMARY OF THE INVENTION

The above and other objects are achieved in the present invention which comprises a wide-band traveling wave amplifier with a special frequency-spreading coupler including a tapered interaction waveguide wherein the cross section thereof gradually increases from a small first end to large second end for propagating electromagnetic energy therein. A tapered input waveguide disposed along the interaction waveguide, with a small third end adjacent to the small first end of the interaction waveguide and a small fourth end adjacent to the small second end of the interaction waveguide is also included for providing electromagnetic waves to be amplified. The input waveguide is positioned so that each cutoff plane in the input waveguide corresponding to $\omega_c$ is displaced in the direction of increasing cross-section of the interaction waveguide from each cutoff plane in the interaction waveguide corresponding to $\omega_c$ where $\omega_c$ is any frequency in the frequency band of the amplifier. Resonant slots, or some alternative coupling mechanism, for coupling the electromagnetic wave at frequency $\omega_c$ from the input waveguide into the interaction waveguide are disposed between the cutoff planes corresponding to $\omega_c$ in the input and interaction waveguides.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
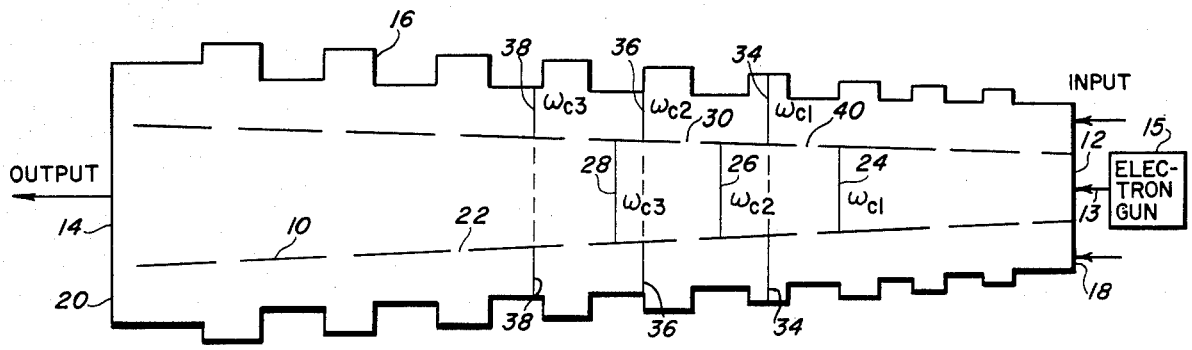
FIG. 1 is cross sectional schematic view of an embodiment of the present invention.

The present invention is directed to a frequency-spreading input coupler in combination with a tapered interaction waveguide. The present combination will be described in the context of a gyrotron amplifier, which is a fast-wave structure, although it should be understood that this combination may be utilized also with slow wave structures with either dielectric or periodic structure loading. or with conventional electron beam amplifiers.

The basic gyrotron traveling-wave amplifier utilizing a tapered interaction waveguide is described in some detail in the aforementioned application by Lau, Barnett, Chu, and Granatstein and in an article entitled "Theory of a Wide-Band Distributed Gyrotron Traveling-Wave Amplifier", by the same authors in IEEE Transactions on Electron Devices, Vol. ED-28, No. 7, July 1981. These two references are hereby incorporated by reference. Amplification in the traveling-wave amplifier described in these references, as in other traveling-wave amplifiers, is based on the coherent stimulated emission of radiation from an electron beam injected into traveling-wave structure by an electron gun. In the case of the gyrotron, the electron cyclotron maser mechanism is utilized to obtain relativistic azimuthal phase bunching which is discussed at some length in the above-incorporated references. In the gyrotron, the phases of the electrons in their cyclotron orbits are initially random. However, relativistic azimuthal bunching occurs when the electrons with their cyclotron motion interact with rf radiation at appropriate frequencies. The resulting phase bunching from this rotating electron interaction with the rf wave causes the electrons to radiate coherently and amplify the wave.

The basic interaction waveguide referred to in the above-incorporated references comprises a waveguide wall which is tapered from a small end to a large end. An electron gun is utilized to generate a beam of electrons to propagate in the tapered interaction waveguide such that the beam copropagates with the rf radiation propagating therein. Accordingly, the electron beam is injected into the small end of the interaction waveguide such that it propagates in the axial direction therein with the wall radius of the waveguide increasing in the downstream direction of the beam. The tapered interaction waveguide, and/or the entire system including the electron gun may be disposed inside a magnetic circuit for generating a magnetic field within the tapered waveguide. When the magnetic field generated by the magnetic circuit is properly profiled relative to the waveguide, wide-band amplification of the rf radiation via coherent electron stimulated emissions will occur.

It can be seen from the above, that the proper wide-band operation of the amplifier will depend, in large measure, on the efficient coupling of wide-band rf energy into the tapered interaction waveguide. The present invention is directed to such a coupling structure in combination with the tapered interaction waveguide.

Briefly. the present invention provides a novel and improved broadband travelling wave amplifier with an input waveguide for injecting a frequency component of an input wave into the interaction waveguide at the point of maximum gain for that frequency component. As described in the above incorporated references, the gain in the tapered interaction waveguide is an axial function of the frequency of the input radiation. The gain for a given frequency component is a maximum near the cutoff plane in the interaction waveguide corresponding to the given frequency. Since the interaction waveguide is tapered, the cutoff plane for a given frequency is displaced toward the larger end of the interaction waveguide as the magnitude of the given frequency decreases.

The input waveguide is a graduated lowpass filter designed so that a first cutoff plane in the input waveguide for a given frequency, $\omega_c$, is positioned nearer to the large end of the interaction waveguide than a second cutoff plane for $\omega_c$ in the interaction waveguide. The frequency component at $\omega_c$ of the input radiation is coupled from the input waveguide into the interaction waveguide through a slot positioned between the first and second cutoff planes. Since the slot is near the cutoff planes for $\omega_c$ in both the interaction waveguide and the input waveguide the coupling co-efficient and gain for the $\omega_c$ frequency component is high.

Referring now to the drawings, wherein like reference characters designate like or corresponding parts throughout the views, FIG. 1 shows the basic frequency-spreading input coupler of the present invention in combination with a tapered interaction waveguide operating in the fundamental $TE_{11}^{o}$ circular waveguide mode. The tapered interaction waveguide 10 has a gradual cross-sectional tapering from a small end 12 to a large end 14. An electron beam 13 is injected axially into the interaction waveguide at the small end 12 by an electron gun 15. This interaction waveguide 10 may take a variety of cross-sectional shapes such as oval, circular, rectangular, square, etc., and may operate in a variety of waveguide modes. For convenience, the waveguide 10 actually constructed will be circular in cross-section.

It should be noted that the interaction waveguide 10 also functions as an output waveguide since the output beam from the gyrotron propagates from the larger end 14 of the interaction waveguide 12.

Since the interaction waveguide is tapered, the cutoff planes for radiation with differing frequencies will be displaced along the axis of the interaction waveguide. A cutoff plane for a given frequency is defined as the plane, oriented perpendicularly to the axis of the waveguide, where radiation propagating in the waveguide is reflected in the direction opposite to its original direction of propagation. In particular, lines 24, 26 and 28 depict the cutoff planes corresponding to $\omega_{c1}$, $\omega_{c2}$, $\omega_{c3}$ respectively. Where $\omega_{c1} > \omega_{c2} > \omega_{c3}$ and where $\omega_{c1}$, $\omega_{c2}$ and $\omega_{c3}$ are frequencies in frequency band of the amplifier. It should be noted that lines 24, 26 and 28 do not represent physical structures but only depict that section of the interaction waveguide where radiation of the frequency corresponding to the plane represented is cutoff.

An input waveguide 16 is utilized to provide the input signal to be amplified. The input waveguide 16 is disposed co-axially about the interaction waveguide 10 and is tapered with its small end 18 near to the small end 12 of the interaction waveguide and its large end 20 near to the large end 14 of the interaction waveguide. The input waveguide is a low pass filter with resonant slots 22 formed along the inner wall to couple the input radiation in the input waveguide 16 into the interaction waveguide 10. The cutoff planes corresponding to $\omega_{c1}$, $\omega_{c2}$ and $\omega_{c3}$ are depicted by lines 34, 36, 38 respectively. The mechanism for efficiently achieving this coupling to assure maximum gain in the amplifier will become clear by reference to the following discussion when considered in connection with FIGS. 2–6.

Figure 2:
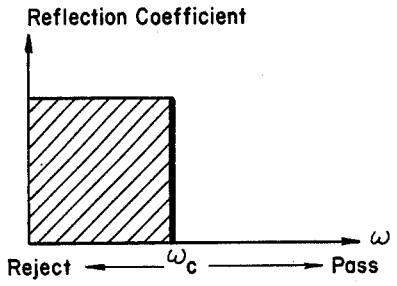
FIG. 2 is a graph depicting the bandpass characteristics of an ideal high-pass filter where the vertical axis represents the reflection coefficient and the horizontal axis represents frequency.
Figure 3:
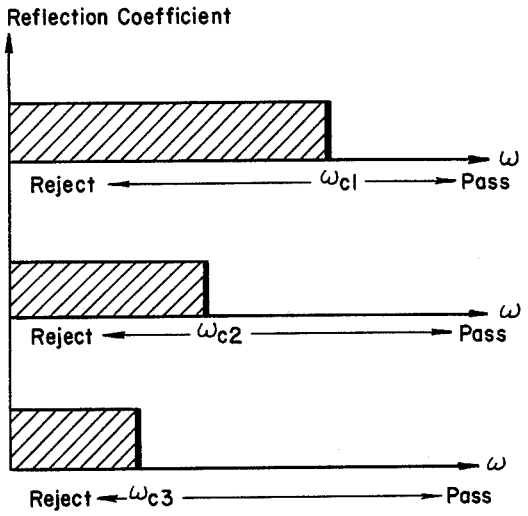
FIG. 3*a, b,* and *c* are graphs depicting the bandpass characteristic of the interaction waveguide of the embodiment depicted in FIG. 1 at lines 24, 26 and 28 respectively.

The invention utilizes the properties of tapered filters. It is well known in the art that a circular waveguide is a high pass filter. FIG. 2 is a graph depicting the bandpass characteristics of an ideal high-pass filter where the horizontal axis represents frequency and the vertical axis represents the reflection coefficient of the waveguide. Note that the reflection coefficient is unity for $\omega<\omega_c$, thus the waveguide does not pass frequencies below $\omega_c$. The cutoff frequency ($\omega_c$) is related to the cutoff wavelenth ($\lambda_c$) by $\omega_c=C/\lambda_c$ where C is a constant. $\lambda_c$, on the other hand, is proportional to the diameter of the circular waveguide. Thus, as the diameter of the waveguide increases $\lambda_c$ increases and $\omega_c$ decreases.

FIGS. 3*a*, 3*b*, and 3*c*, are graphs depicting the bandpass characteristics of the tapered interaction waveguide at the planes represented by the lines 24, 26 and 28 respectively. Note that as diameter of the waveguide increases $\omega_c$ decreases so that more frequencies are passed. More particularly note that if radiation with frequency $\omega_{c2}$ and wavelength $\lambda_{c2}$ is coupled into the interaction waveguide at the slot 30 located just to the left of plane 26 then the radiation will be passed in the direction of increasing diameter (forward) but rejected in the direction of decreasing diameter (backward). This rejection is analogous to the reflection effect of a conducting plane positioned near plane 26.

Figure 4:
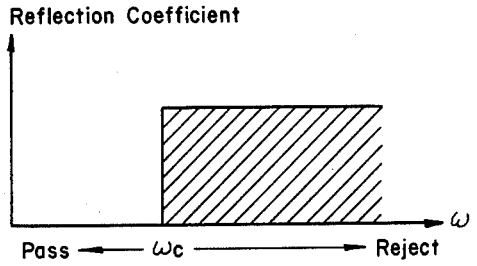
FIG. 4 is a graph depicting the bandpass characteristics of an ideal low-pass filter.
Figure 5:
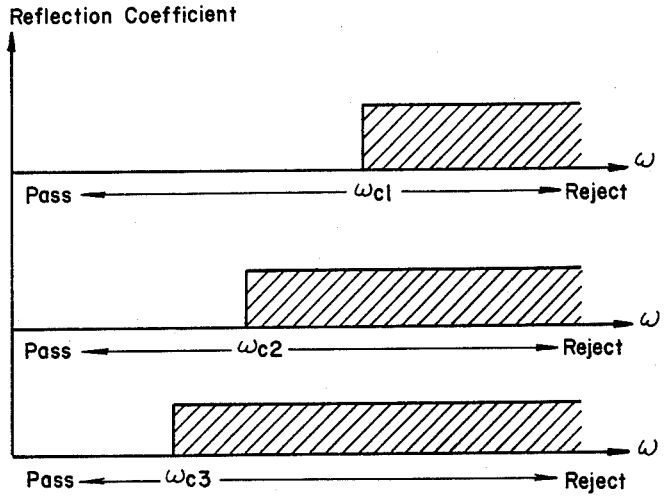
FIGS. 5*a, b* and *c* are graphs depicting the bandpass characteristic of the lines 34, 36 amd 38 respectively.

The input waveguide is a coaxial lowpass filter. FIG. 4 is a graph depicting the bandpass characteristics of an ideal low pass filter. Note that the reflection coefficient is unity for $\omega>\omega_c$, thus the filter does not pass frequencies above $\omega_c$. Low pass filters may be transversely ridged coaxial waveguides or waffle iron filters, the properties of which are described in the book by G. Matthaei, L. Young and E. M. T. Jones entitled *Microwave Filters, Impedance -Matching Networks, and Coupling Structures,* Artech House, Dedham, MA, 1980.

In the input waveguide depicted in FIG. 1 the height and spacing of the ridges increases as the cross-section of the input waveguide increases. As set forth in the above-referenced book, the cutoff frequency of the low pass filter decreases as the height and spacing of the ridges increases. Thus, by selecting the height and spacing of the ridges by utilizing methods well-known in the art, the cutoff planes may be spaced to conform with the requirements of the invention.

FIG. 5*a*, *b*, and *c* are graphs depicting the bandpass characteristics of the tapered input waveguide at the planes represented by the solid lines 34, 36, and 38 respectively in FIG. 1. Note that as the cross-sectional thickness of the input waveguide increases $\omega_c$ decreases so that fewer frequencies are passed. In particular note that if radiation at frequency $\omega_{c2}$ and wavelength $\omega_{c2}$ is fed into the input waveguide at the small end 18 then the radiation in the input guide cannot propagate beyond the cutoff plane 36.

Figure 6:
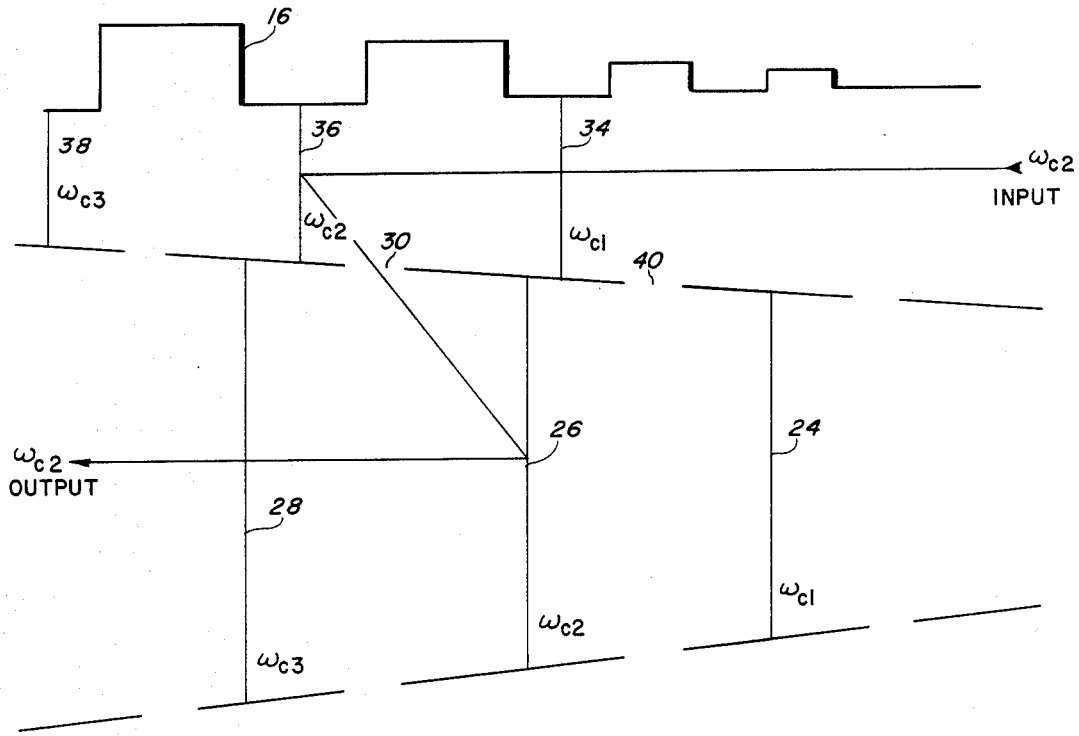
FIG. 6 is an expanded view of a section of FIG. 1.

Turning now to FIG. 6, which is an enlargement of a section of FIG. 1, the planes 34, 36, and 38 are the cut-off planes of the input waveguides for $\omega_{c1}$, $\omega_{c2}$ and $\omega_{c3}$ respectively. As described above, radiation fed into the narrow end of the input waveguide number will be reflected in that guide by the cutoff plane corresponding to the frequency of the input radiation, and will couple through the coupling holes in and around that plane into the interaction waveguide 10.

The planes 24, 26, and 28 are the cut-off planes corresponding to $\omega_{c1}$, $\omega_{c2}$ and $\omega_{c3}$ in the interaction waveguide 10. As described above, radiation propagating toward the narrow end of the interaction waveguide will be reflected at the cut-off plane corresponding to the frequency of the radiation, and will thus propagate only in one direction (to the left in FIGS. 1 and 6) in the interaction guide.

The operation of the coupler will now be described for the specific case of input radiation of frequency $\omega_{c2}$ fed into the input waveguide. This description may easily be applied to frequencies $\omega_{c1}$ and $\omega_{c3}$, and also to the general case.

Input radiation at frequency $\omega_{c2}$ from any standard microwave source, such as a klystron or magnetron, is fed into the small end 18 of the input waveguide. As the input wave propagates to the left in FIG. 6 it will pass over slot 40. However, none of the input wave will be coupled into the interaction waveguide through slot 40 since $\omega_{c2}$ is cutoff in this region of the interaction waveguide. Thus the input wave will continue to propagate to the left in the input waveguide until it is cutoff at plane 36. As is well known in the art, the energy density of a wave is at a maximum near the cutoff point in a waveguide. Therefore the energy density of the input waveguide above the slot 30 is high and most of the input wave is coupled into the interaction waveguide thru slot 30. Note that in the region below slot 30 the interaction waveguide is above cutoff so that the radiation will propagate in the forward direction. As described in the above-reference patent application by Lau et al., the gain of the distributed amplifier is a maximum when the input beam is injected near the cutoff plane of the tapered interaction waveguide. This gain maximum is achieved by the present invention since the coupling slot 30 is almost directly above the cutoff plane 26 corresponding to $\omega_{c2}$ in the interaction waveguide.

The coupling slots are resonant slots, the design of which is well known in the art and is set forth, for example, in the above - referenced book by Matthaei, Young and Jones. It is to be understood that the term slot, as used herein, refers to an opening through the sides of the input and interaction waveguide of any shape that functions to couple the radiation modes therebetween. Alternative coupling means such as non resonant slots, probes or loops may be utilized depending on the design of the amplifier.

It is to be understood that although a coaxial, tapered input waveguide disposed about a circular, tapered interaction waveguide has been utilized in the present design as the preferred frequency-spreading coupler embodiment, other configurations may be utilized. In fact, the configuration of the interaction waveguide dictates the configuration on the input waveguide. As amplifiers utilizing distributed interaction waveguides of various designs are developed the principles of the invention disclosed and claimed herein will enable the construction of the appropriate frequency-spreading coupler. For example, FIG. 1 may depict the cross-section of an amplifier with square input and interaction waveguides.

The particular dimensions of the invention will be determined by the frequency, wavelength and frequency band of the radiation to be amplified according to the principles disclosed and referenced herein.

Obviously, numerous (additional) modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. A travelling wave amplifier comprising:

a tapered interaction waveguide wherein the cross-section thereof gradually increases from a small first end to a large second end for propagating electromagnetic energy in a broad frequency band therein, said interaction waveguide having a plurality of first cutoff planes corresponding to frequencies in the frequency band of the amplifier;

means for injecting an electron beam into the small end of said interaction waveguide;

an input waveguide for receiving electromagnetic waves to be amplified therein, wherein said input waveguide is a tapered low pass filter having a small third end and large fourth end, said input waveguide being coaxially disposed around said interaction waveguide with said small third end adjacent to said small first end and said large fourth end adjacent to said large second end, said input waveguide with a plurality of second cutoff planes corresponding to frequencies in the frequency band of the amplifier, wherein said input waveguide is positioned so that each of said second cutoff planes in said input waveguide corresponding to $\omega_c$ is displaced in the direction of increasing cross-section of said interaction waveguide from each of said first cutoff planes in said interaction waveguide corresponding to $\omega_c$, where $\omega_c$ is any frequency in the frequency band of the amplifier; and coupling means, disposed between the cutoff planes corresponding to $\omega_c$ in said interaction waveguide and said input waveguide, for coupling the electromagnetic waves in said input waveguide into said interaction waveguide.

2. The travelling wave amplifier recited in claim 1 wherein:

said input waveguide a transversely-ridged low pass filter.

3. The travelling wave amplifier recited in claim 1 wherein:

said input waveguide is a waffle iron low pass filter.

4. The travelling wave amplifier recited in claim 1, 2 or 3 wherein:

said input waveguide is disposed coaxially about said tapered interaction waveguide.

5. The travelling wave amplifier recited in claim 1, 2 or 3 wherein:

said coupling means comprises a plurality resonant slots disposed between said interaction waveguide and said input waveguide.

6. The travelling wave amplifier recited in claim 4 wherein:

said coupling means comprises a plurality resonant slots disposed between said interaction waveguide and said input waveguide.

7. A frequency-spreading coupler for coupling electromagnetic energy from a source to a propagation mode in a tapered interaction waveguide of a travelling wave amplifier where the interaction waveguide is of the type with a plurality of first cutoff planes corresponding to frequencies in the frequency band of the amplifier, said coupler comprising:

an input waveguide with electromagnetic energy from the source propagating therein where said input waveguide is a tapered low pass filter, said input waveguide having a plurality of second cutoff planes corresponding to frequencies in the frequency band of the of the amplifier, wherein said input waveguide is positioned relative to the interaction waveguide with each of said second cutoff planes in said input waveguide corresponding to $\omega_c$ displaced in the direction of increasing cross-section of the tapered interaction waveguide from each of said first cutoff planes in the interaction waveguide corresponding to $\omega_c$ where $\omega_c$ is any frequency in the frequency band of the travelling wave amplifier; and coupling means, disposed between the cutoff planes corresponding to $\omega_c$ in said interaction waveguide and said input waveguide, for coupling the electromagnetic energy in said input waveguide into said interaction waveguide.

8. The frequency-spreading coupler recited in claim 7 wherein:

said input waveguide is a transversely ridged low pass filter.

9. The frequency-spreading coupler recited in claim 7 wherein:

said input waveguide is a waffle iron low pass filter.

10. The frequency spreading coupler recited in claim 7, 8 or 9 wherein:

said input waveguide is disposed coaxially about said tapered interaction waveguide.

11. The frequency-spreading coupler recited in claim 7, 8 or 9 wherein:

said coupling means comprises a plurality resonant slots disposed between said interaction waveguide and said input waveguide.

12. The frequency-spreading coupler recited in claim 10 wherein:

said coupling means comprises a plurality of resonant slots disposed between said interaction waveguide and said input waveguide.

13. A frequency spreading coupler for coupling electromagnetic energy from a source to a propagation mode in a tapered, cylindral interaction waveguide of a travelling wave amplifier, where said interaction waveguide has a small first end and a large second end and said interaction waveguide is of the type with a plurality of first cutoff planes corresponding to frequencies in the frequency band of the amplifier, said frequency spreading coupler comprising:

a tapered input waveguide disposed coaxially about said interaction waveguide, said input waveguide with a small third end and a large fourth end, wherein said input waveguide is positioned with its small third end adjacent to the small first end of said interaction waveguide and its large fourth end adjacent to the large second end of said interaction waveguide, where said input waveguide is a transversely ridged low pass fiter, said input waveguide with a plurality of second cutoff planes corresponding to frequencies in the frequency band of the amplifier, where said input waveguide is positioned relative to said interaction waveguide so that each of said second cutoff planes in said input waveguide corresponding to $\omega_c$ is displaced in the direction of increasing taper of said interction waveguide from each of said first cutoff planes in said interaction waveguide corresponding to $\omega_c$ where $\omega_c$ is any frequency in the frequency band of the travelling wave amplifier, and wherein electromagnetic energy is coupled from said input waveguide into said interaction waveguide by a plurality of slots disposed between the cutoff planes in said interaction waveguide and said input waveguide corresponding to $\omega_c$.

14. The frequency spreading coupler described in claim 13 wherein:

said slot is a resonant slot.

15. A travelling wave amplifier comprising:

a tapered interaction waveguide with a circular cross-section wherein the cross-section thereof gradually increases from a small first end to a large second end for propagating electromagnetic energy in a broad frequency band therein, said interaction waveguide having a plurality of first cutoff planes corresponding to frequencies in the frequency band of the amplifier;

means for injecting an electron beam into the small end of said interaction waveguide;

an input waveguide for receiving electromagnetic waves to be amplified therein, wherein said input waveguide is a tapered low pass filter having a small third end and large fourth end, said input waveguide being coaxially disposed around said interaction waveguide with said small third end adjacent to said small first end and said large fourth end adjacent to said large second end, said input waveguide with a plurality of second cutoff planes corresponding to frequencies in the frequency band of the amplifier, wherein said input waveguide is positioned so that each of said second cutoff planes in said input waveguide corresponding to $\omega_c$ is displaced in the direction of increasing cross-section of said interaction waveguide from each of said first cutoff planes in said intereaction waveguide corresponding to $\omega_c$, where $\omega_c$ is any frequency in the frequency band of the amplifier; and coupling means, disposed between the cutoff planes corresponding to $\omega_c$ in said interaction waveguide and said input waveguide, for coupling the electromagnetic waves in said input waveguide into said interaction waveguide.

16. The travelling wave amplifier recited in claim 15 wherein:

said input waveguide is a transversely-ridged low pass filter.

17. The travelling wave amplifier recited in claim 15 wherein:

said input waveguide is a waffle iron low pass filter.

18. The travelling wave amplifier recited in claim 15, 16 or 17 wherein:

said coupling means comprises a plurality of resonant slots disposed between said interaction waveguide and said input waveguide.

19. A frequency-spreading coupler for coupling electromagnetic energy from a source to a propagation mode in a tapered interaction waveguide of a travelling wave amplifier where the interaction waveguide has a circular cross section and is of the type with a plurality of first cutoff planes corresponding to frequencies in the frequency band of the amplifier, said coupler comprising:

an input waveguide with electromagnetic energy from the source propagating therein where said input waveguide is a tapered low pass filter, said input waveguide having a plurality of second cutoff planes corresponding to frequencies in the frequency band of the of the amplifier, wherein said input waveguide is coaxially disposed around the interaction waveguide with each of said second cutoff planes in said input waveguide corresponding to $\omega_c$ displaced in the direction of increasing cross-section of the tapered interaction waveguide from each of said first cutoff planes in the interaction waveguide corresponding to $\omega_c$, where $\omega_c$ is any frequency in the frequency band of the travelling wave amplifier; and coupling means, disposed between the cutoff planes corresponding to $\omega_c$ in said interaction waveguide and said input waveguide, for coupling the electromagnetic energy in said input waveguide into said interaction waveguide.

20. The frequency-spreading coupler recited in claim 19 wherein:

said input waveguide is a transversely ridged low pass filter.

21. The frequency-spreading coupler recited in claim 19 wherein:

said input waveguide is a waffle iron low pass filter.

22. The frequency-spreading coupler recited in claim 19, 20 or 21 wherein:

said coupling means comprises a plurality of resonant slots disposed between said interaction waveguide and said input waveguide.

* * * * *